United States Patent [19]

Zorini

[11] Patent Number: 4,845,962

[45] Date of Patent: Jul. 11, 1989

[54] FABRIC HEATING UNIT IN CROCHET GALLOON LOOMS

[75] Inventor: Luigi O. Zorini, Cilavegna, Italy

[73] Assignee: Comez, S.p.A., Cilavegna, Italy

[21] Appl. No.: 229,217

[22] Filed: Aug. 5, 1988

[30] Foreign Application Priority Data

Oct. 13, 1987 [IT] Italy ..... 22259A/87

[51] Int. Cl.[4] ..... D04B 35/00

[52] U.S. Cl. ..... 66/147; 66/203; 28/172

[58] Field of Search ..... 66/147, 203; 28/172

[56] References Cited

U.S. PATENT DOCUMENTS

| | | | |
|---|---|---|---|
| 2,578,889 | 12/1951 | Kennedy | 66/147 |
| 2,601,770 | 7/1952 | Goldsmith | 66/147 |
| 3,234,971 | 2/1966 | Horne et al. | 66/147 |
| 3,727,433 | 4/1973 | Hamiano | 66/147 |
| 4,551,995 | 11/1985 | Lovison | 66/203 |
| 4,630,340 | 12/1986 | Bauer et al. | 28/172 X |

*Primary Examiner*—Ronald Feldbaum

*Attorney, Agent, or Firm*—Laff, Whitesel, Conte & Saret

[57] ABSTRACT

It is described a fabric heating unit 1 comprising a pair of heating elements 7, 8 each of them exhibiting an active surface 10*a* designed to come in contact with one of the faces of a fabric 3 coming out of a crochet galloon loom. Associated with each heating element is an insulating shield rotatably pivoted according to an axis parallel to the respective heating element. The insulating shields can be simultaneously brought from a rest position in which each of them is disposed close to the respective heating element on the side opposite that facing the fabric, to an operating position in which each shield is interposed between the heating element and the fabric to separate and thermally insulate the latter from the heating element.

6 Claims, 1 Drawing Sheet

1
2
3
4
5
5a
6
6a
7
8
9
10
10a
11
12
13
14
15
16
17
18
19
20
21
22

FABRIC HEATING UNIT IN CROCHET GALLOON LOOMS

BACKGROUND OF THE INVENTION

1. Field of the Invention

The present invention relates to a fabric heating unit in crochet galloon looms, of the type comprising at least a heating element extending transversely to a fabric coming out of a crochet galloon loom and exhibiting an active surface designed to come in contact with said fabric and shielding means to reduce the heating action exerted on the fabric by the heating element.

2. Prior Art

It is know that fabrics produced by means of crochet galloon looms need to be submitted, before further workings, to dimensional stabilization treatments during which the fabric must undergo an appropriate heating.

The most conventional methods to carry out dimensional stabilization involve the use of specific equipments acting in a manner completely independent of the loom. With the use of these equipments the dimensional stabilization treatments clearly represent an additional working step to which the fabric must be submitted.

In order to eliminate this additional working step provision has been made for heating units directly mounted on the loom and acting so as to carry out the dimensional stabilization treatment as the fabric is being produced by the loom.

These heating units essentially comprise one or more heating elements consisting of cylindrical rollers heated by respective resistors and disposed so as to make the fabric slide thereon before it is wound around a reception cylinder.

While passing on said heating rollers the fabric undergoes an appropriate heating giving it the desired dimensional stabilization, with a more or less marked shrinkage.

Furthermore the resistor or resistors associated with each of said heating rollers are disposed eccentrically to the axis of the roller and therefore they are adjacent a localized area of the outer circumferential extension thereof. This area defines an active surface on which the fabric is obliged to slide during the normal working of the loom.

When for any reason the loom operation is stopped, the heating cylinders are automatically rotated through 180° so that the fabric may rest on the surfaces thereof which are the farthest from the resistors and consequently less influenced by the heating action of said resistors.

In this manner the fabric does not run the risk of being overheated or burnt when its sliding on the heating cylinders is stopped.

Known heating units have some drawbacks. For example they consume a lot of energy due to the high amount of heat dissipated by the heating rollers which actually have an important mass with rather extended radiant surfaces.

The important mass of the heating rollers also involves long times to bring the latter to the appropriate exercise temperature during the loom starting steps after the loom has stopped for a long time.

Also due to the important mass of the rollers, it is necessary to use motors provided with high power in order to achieve the immediate rotations through 180° of said rollers after each stopping and new operation of the loom.

It is also to be noted that, in spite of the resistors being disposed so as to accomplish a localized heating in specific areas of the rollers, an important amount of heat is also transmitted to the areas which are the farthest from said resistors. Under this situation, notwithstanding the rotation through 180° performed by the heating rollers, when the loom stops an overheating of the fabric may occur, which will bring about a damage to the fabric above all when the latter is very delicate.

In addition, due to the fact that the fabric heating is only localized in specific areas of the roller, the fabric is often submitted to very high temperatures. Obviously, by effect of the fabric sliding, said high temperatures have a very short duration, but it would be better to submit the fabric to lower temperatures for longer times in order to achieve an optimal dimensional stabilization without running the risk of damaging the fabric.

SUMMARY OF THE INVENTION

It is an object of the present invention to solve all the drawbacks hereinabove described with reference to known art, by providing a heating unit adapted to allow the use of heating elements having limited sizes and wide, homogeneously heated active surfaces without needing the use of high-power motors for the achievement of a thermal fabric insulation from the active surfaces during a stopping step of the loom.

The foregoing and further objects which will become more apparent in the course of the present description are substantially attained by a fabric heating unit in crochet galloon looms wherein said shielding means comprises at least an insulating shield rotatably engaged about the heating element according to an axis substantially parallel to the latter and movable upon command of actuator means, from a rest position in which it is disposed alongside the heating element on the side opposite that facing the fabric to an operating position in which it is interposed between the heating element and the fabric to accomplish a thermal insulation therebetween.

BRIEF DESCRIPTION OF THE DRAWINGS

Further features and advantages will best be understood from the detailed description of a preferred embodiment of a fabric heating unit in crochet galloon looms in accordance with the present invention given hereinafter by way of non-limiting example with reference to the accompanying drawings, in which.

DESCRIPTION OF THE PREFERRED EMBODIMENT

Figures 1, 2:
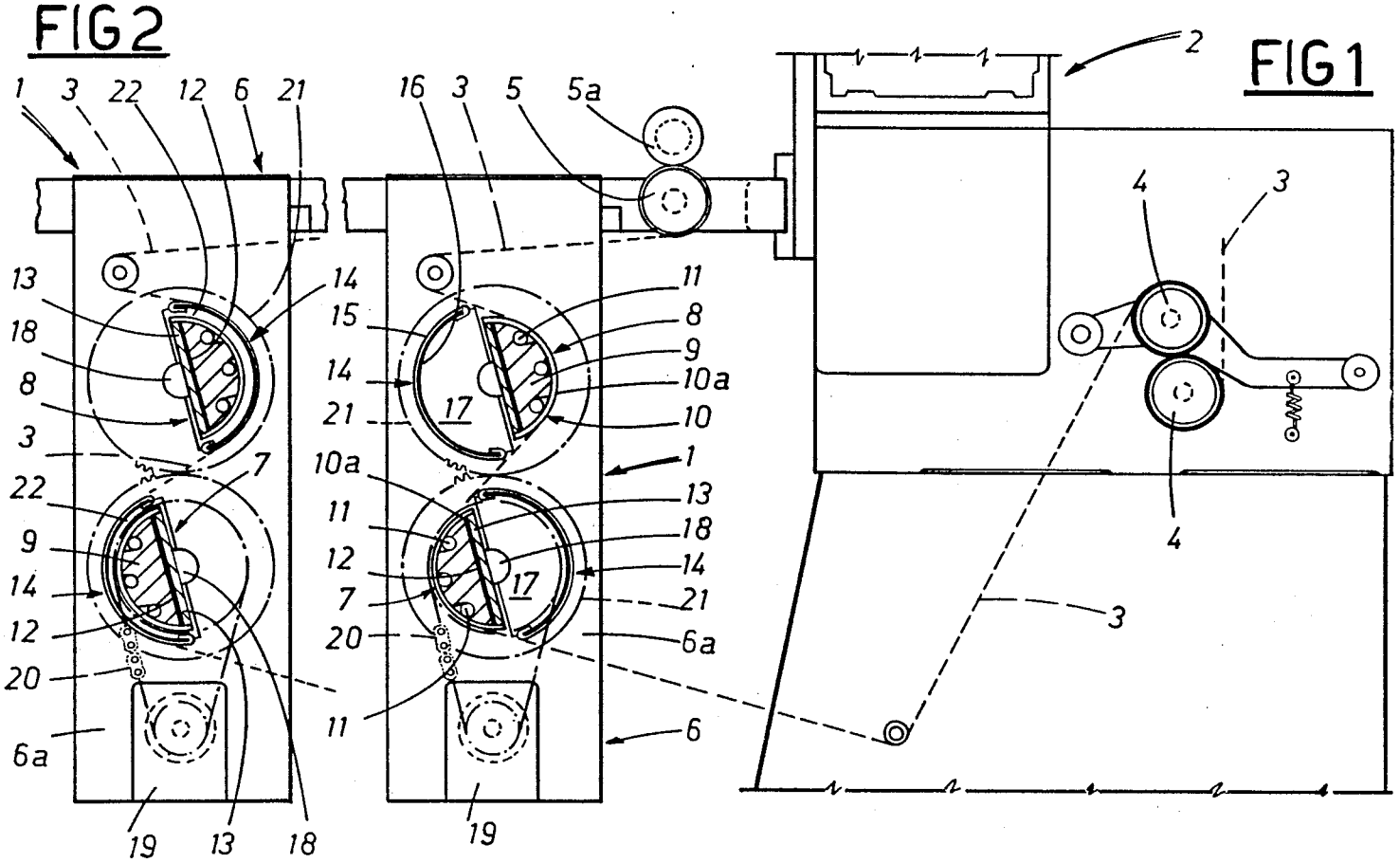
FIG. 1 is a broken diagrammatic side view, partially in section, of the heating unit associated with a crochet galloon loom during a normal operation step.
FIG. 2 is a diagrammatic sectional side view of the equipment shown in FIG. 1 during a non-operation step of the loom.

With reference to the drawings, a fabric heating unit in crochet galloon looms in accordance with the present invention has been globally identified by reference numeral 1.

Said heating unit is associated with a conventional crochet galloon loom only the outlet area of which has been partially shown and globally identified by 2. A fabric 3 upon the action of known means acting upstream of said outlet area, is engaged by pulling rollers 4 actuated by a motor and suitably guided so that the fabric may be wound on a reception roller 5 taken in rotation by a powered counter-roller 5*a*.

The heating unit 1, which is disposed in front of the outlet area 2, comprises a supporting framework 6 provided with two posts 6*a* (only one of which is shown in the accompanying figures) between which at least a heating element is fixedly fastened.

As shown in the drawings and according to a preferred embodiment, provision is made for a first heating element 7 and a second heating element 8. Heating elements 7, 8 preferably have a substantially semicircular section the convex portions of which are oriented towards opposite sides so that they may come in contact with the opposite faces of the fabric which takes a substantially S-shaped path about said heating elements.

Each heating element 7, 8 comprises a core 9 made of a conductive material and having a substantially semicircular section. Located on the convex surface of said core is a covering plate 10 forming an active surface 10a on which fabric 3 slides.

Incorporated in core 9 is at least a resistor 11 located immediately below the covering plate 10. Preferably several resistors 11 are provided and they are distributed over the whole circumferential arc described by plate 10 so as to carry out a homogeneous heating of the active surface 10*a*.

On the opposite side with respect to the covering plate 10, each heating element 7, 8 has a refractory lining 12 made of insulating material on which an auxiliary covering plate 13 is preferably placed.

In an original manner, associated with each heating element 7, 8 is an insulating shield 14 exhibiting a semicircular section the circumferential arc of which has a slightly bigger radius than that of the arc described by the covering plate 10.

Each insulating shield 14 comprises an outer plate 15 coupled to a refractory lining 16 and in the region of its side walls 17 is rotatably connected to pivots 18 around which it rotates, said pivots fixedly connecting the respective heating elements 7, 8 to posts 6*a*. The rotary engagement of shields 14 about pivots 18 allows each shield to rotate about its respective heating element 7, 8 according to an axis parallel to the longitudinal extension thereof. In the example shown, the axis of rotation of shield 14 is coincident with the axis of the circumferential arc described by the corresponding covering plate 10.

The rotation of the insulating shields 14 is achieved by actuator means consisting of an actuation motor 19 connected through a gear chain 20 to the shield 14 of the first heating element 7. Shields 14 are operatively connected to each other with a gear ratio of 1:1 by respective gear wheels 21 or the like so that the rotation of the shield associated with the first heating element 7 brings about the rotation of the shield associated with the second heating element 8.

Operation of the heating unit according to the invention described above mainly as regards structure is as follows.

During the normal operation of the loom each insulating shield 14 is kept in a rest position in which it is disposed adjacent the respective heating element 7, 8 on the opposite side with respect to fabric 3. Therefore as said fabric is produced and wound around the reception roller 5, it is subjected to slide along the active surfaces 10*a* of the heating elements 7, 8 taking a substantially S-shaped path between said heating elements. Due to the action of resistors 11 through the active surfaces 10*a*, fabric 3 is suitably heated in order to achieve the desired dimensional stabilization thereof.

If the loom stops, (and, as a result, also the forward movement of fabric 3), there will be the actuation of motor 19 and, due to said actuation, the insulating shields 14 will be brought through a rotation of 180° from a rest position to an operating position in which, as shown in FIG. 2, they will be interposed between the respective heating elements 7, 8 and the fabric 3. Because of the structure of shields 14, when they are in an operating position a hollow space 22 will be formed between the latter and the corresponding active surfaces. Under this situation fabric 3 will be separated from active surfaces 10*a* and thermally insulated therefrom. Thus all risks of fabric overheating or burning will be eliminated.

The invention attains the intended purposes.

In fact it will be recognized that the presence of the above described insulating shields allows heating elements of very reduced sizes as compared with known art elements to be adopted in the heating unit in question, with active surfaces homogeneously heated according to areas having a remarkable extension. Thus high heat dissipations towards the surrounding atmosphere can be avoided as well as all risks of overheating the fabric while the dimensional stabilization is being carried out.

In addition, insulating shields 14 have a very reduced mass and can be brought from a rest position to an operating position with the aid of low-power motors. Furthermore due to the structure and size of said shields 14 it is advantageously possible to create an almost complete thermal insulation between heating elements 7, 8 and fabric 3. In fact, when shields 14 are in an operating position, by virtue of the hollow space created between the heating elements and said shields, the possible transmission of heat between the heating elements and the fabric can only take place by convection and radiation, while, on the contrary, in the known art the fabric which was directly in contact with the heating elements was submitted to a non-negligible amount of heat transmitted by conduction.

Obviously the present invention is susceptible of many modifications and variations, all falling within the scope of the inventive idea characterizing it.

What is claimed is:

1. A fabric heating unit in crochet galloon looms comprising at least a heating element extending transversely to a fabric coming out of a crochet galloon looms and exhibiting an active surface designed to come in contact with said fabric and shielding means to reduce the heating action exerted on the fabric by the heating element wherein said shielding means comprises at least an insulating shield rotatably engaged about the heating element according to an axis substantially parallel to the longitudinal extension of the latter and movable upon command of actuator means, from a rest position in which it is disposed alongside the heating element on the side opposite that facing the fabric to an operating position in which it is interposed between the heating element and the fabric to accomplish a thermal insulation therebetween.

2. The fabric heating unit as claimed in claim 1, wherein said heating element has a substantially semicircular section and is internally provided with a number of resistors distributed over a convex portion thereof, in which region said active surface is formed.

3. The fabric heating unit as claimed in claim 1, wherein said insulating shield has a section extending according to a circumferential arc concentric with the axis of rotation of the insulating shield itself.

4. The fabric heating unit as claimed in claim 1, wherein said heating element has a substantially semicircular section and the active surface is formed in the region of a convex portion thereof, said insulating shield exhibiting a section which extends concentrically with the axis of rotation of the shield and the axis of the circumferential arc of said convex portion, according to a circumferential arc having a slightly bigger radius than the convex portion bending in order to create a hollow space between the heating element and the insulating shield when the latter is in an operating position.

5. The fabric heating unit as claimed in claim 1, comprising two heating elements provided with respective insulating shields exhibiting a substantially semicircular section with convex portions oriented towards opposite sides in order to carry out the heating of the fabric on opposite faces thereof.

6. The fabric heating unit as claimed in claim 5, wherein said insulating shields are operatively connected to each other with a gear ratio of 1:1 and movable from a rest position to an operating position and vice-versa upon command of at least a motor acting on one of said insulating shields.

* * * * *